US010570556B2

(12) United States Patent
Leibman

(10) Patent No.: US 10,570,556 B2
(45) Date of Patent: Feb. 25, 2020

(54) SPOT TREATING DEVICE FOR A WASHING MACHINE APPLIANCE

(71) Applicant: Haier US Appliance Solutions, Inc., Wilmington, DE (US)

(72) Inventor: Alexander B. Leibman, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 154 days.

(21) Appl. No.: 15/832,866

(22) Filed: Dec. 6, 2017

(65) Prior Publication Data

US 2019/0169782 A1 Jun. 6, 2019

(51) Int. Cl.

| | |
|---|---|
| ***D06F 29/00*** | (2006.01) |
| ***D06F 43/00*** | (2006.01) |
| ***D06F 39/00*** | (2020.01) |
| ***D06F 33/02*** | (2006.01) |
| ***D06F 37/12*** | (2006.01) |
| ***D06F 39/02*** | (2006.01) |
| ***D06F 35/00*** | (2006.01) |
| *D06F 39/12* | (2006.01) |
| *D06F 39/08* | (2006.01) |
| *D06F 19/00* | (2006.01) |
| *D06F 23/04* | (2006.01) |

(52) U.S. Cl.

CPC ..... *D06F 43/002* (2013.01); *D06F 29/00* (2013.01); *D06F 33/02* (2013.01); *D06F 35/006* (2013.01); *D06F 37/12* (2013.01); *D06F 39/005* (2013.01); *D06F 39/022* (2013.01); *D06F 19/00* (2013.01); *D06F 23/04* (2013.01); *D06F 39/00* (2013.01); *D06F 39/088* (2013.01); *D06F 39/12* (2013.01)

(58) Field of Classification Search

None

See application file for complete search history.

(56) References Cited

U.S. PATENT DOCUMENTS

| | | | | |
|---|---|---|---|---|
| 2,647,433 A * | 8/1953 | Yale | G01J 3/02 356/424 |
| 6,886,371 B2 * | 5/2005 | Arai | D06F 19/00 68/13 R |
| 7,814,768 B2 | 10/2010 | Vecchi et al. | |
| 8,549,887 B2 | 10/2013 | Reid et al. | |

* cited by examiner

*Primary Examiner* — Michael E Barr
*Assistant Examiner* — Jason P Riggleman
(74) *Attorney, Agent, or Firm* — Dority & Manning, P.A.

(57) ABSTRACT

A washing machine appliance that includes a spot treating device is provided. The spot treating device includes features that allow a user to conveniently spot treat laundry articles and provides for an improved visual rendering of the laundry articles during a treatment operation.

17 Claims, 10 Drawing Sheets

SPOT TREATING DEVICE FOR A WASHING MACHINE APPLIANCE

FIELD OF THE INVENTION

The present subject matter relates generally to washing machine appliances and more particularly to spot treating devices for washing machine appliances.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, wash fluid is directed into the tub and onto articles within the wash chamber of the basket. The basket or an agitation element can rotate at various speeds to agitate articles within the wash chamber, to wring wash fluid from articles within the wash chamber, etc.

In certain situations, a user may wish to treat certain laundry articles before or after washing them in the washing machine appliance. For instance, a user may wish to spot treat a stain on a laundry article. Conventionally, to spot treat stains on such articles, users have had to transport the articles to another location away from the washing machine appliance, such as e.g., to a kitchen sink, or have had to use a separate spot treating device to treat their laundry articles. Transporting the soiled laundry articles to a different location or using a separate spot treating device to spot treat articles may be an inconvenience to users. Additionally, in some instances, stains may be difficult to see before or during a treatment operation. For instance, lighting conditions may be less than ideal, the stain or stains may somewhat blend into the article, and due to the material of some articles, it may be difficult to see if the treatment operation is actually removing the stain. Further, after treatment, the treated area may be difficult to inspect due to such conditions.

Accordingly, a washing machine appliance that includes a spot treating device that addresses one or more of the noted challenges would be desirable.

BRIEF DESCRIPTION OF THE INVENTION

The present disclosure provides a washing machine appliance that includes a spot treating device. The spot treating device includes features that allow a user to conveniently spot treat laundry articles and provides for an improved visual rendering of the laundry articles during a treatment operation. Additional aspects and advantages of the invention will be set forth in part in the following description, or may be apparent from the description, or may be learned through practice of the invention.

In one exemplary embodiment, a washing machine appliance is provided. The washing machine appliance defines a vertical, a lateral, and a transverse direction. The washing machine appliance includes a cabinet including a top panel. The top panel defines an opening. The washing machine appliance also includes a tub positioned within the cabinet. Further, the washing machine appliance includes a wash basket rotatably mounted within the tub, the wash basket defining a wash chamber for receiving articles for washing. In addition, the washing machine appliance includes a spot treating assembly for treating articles. The spot treating assembly includes a hose fluidly connected with a water supply and a spot treating device. The spot treating device includes a housing defining a main opening extending therethrough and one or more spray openings fluidly connected with the hose for dispensing a wash fluid. The spot treating device also includes a magnifying device disposed within the main opening of the housing for magnifying articles.

In another exemplary embodiment, a washing machine appliance is provided. The washing machine appliance defines a vertical, a lateral, and a transverse direction. The washing machine appliance includes a cabinet including a top panel. The top panel defines an opening. The washing machine appliance also includes a tub positioned within the cabinet. Further, the washing machine appliance includes a wash basket rotatably mounted within the tub, the wash basket defining a wash chamber for receiving articles for washing. The washing machine appliance further includes a spot treating device for treating articles. The spot treating device includes a housing and a fluid delivery conduit fluidly connecting the spot treatment device with a fluid supply. Further, the spot treating device includes a magnifying device attached to at least one of the fluid delivery conduit and the housing for magnifying articles.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
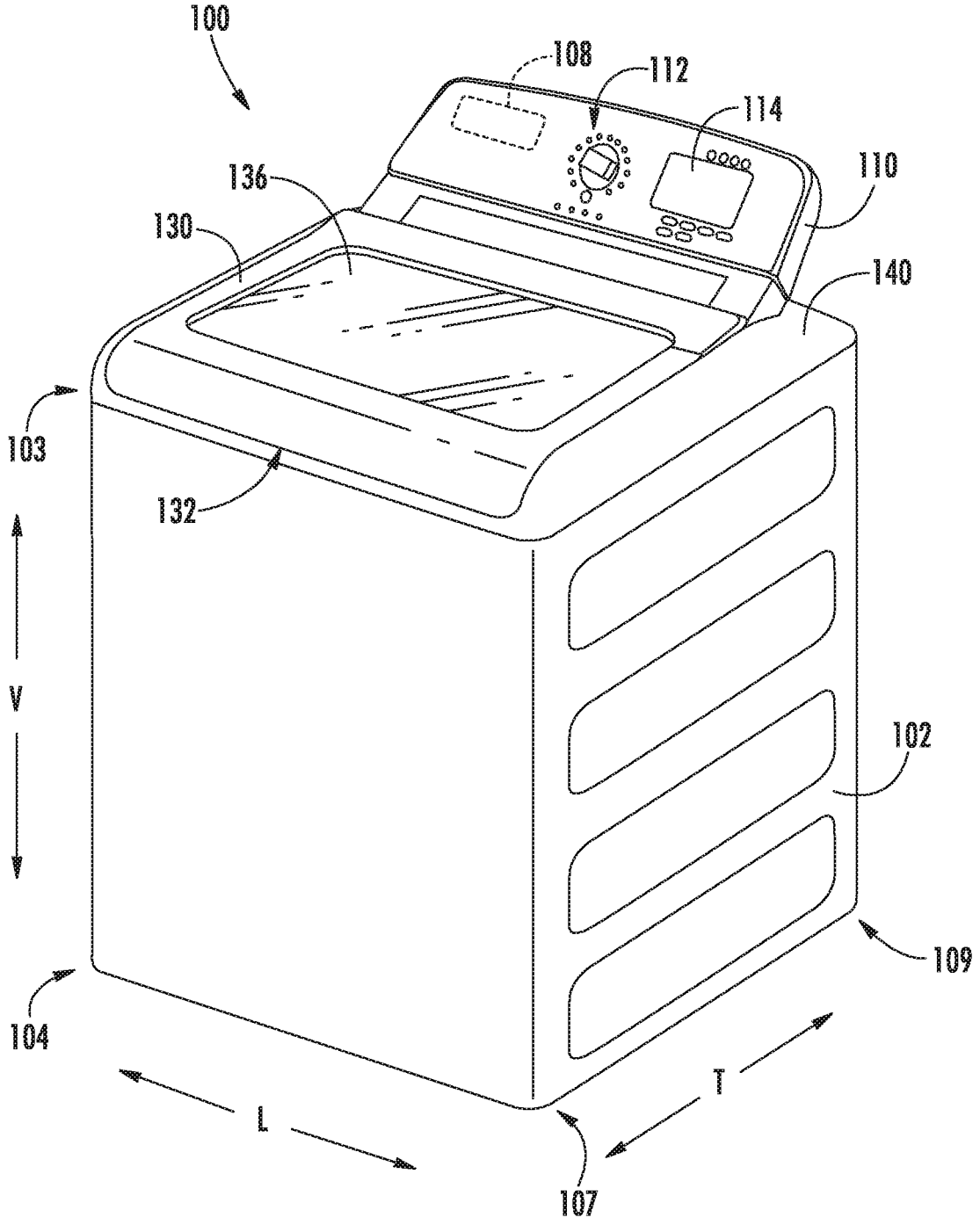
FIG. 1 provides a perspective view of a washing machine appliance according to an exemplary embodiment of the present disclosure with a door of the exemplary washing machine appliance shown in a closed position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents. As used herein, terms of approximation, such as "approximately," "substantially," or "about," refer to being within a ten percent margin of error.

Figure 2:
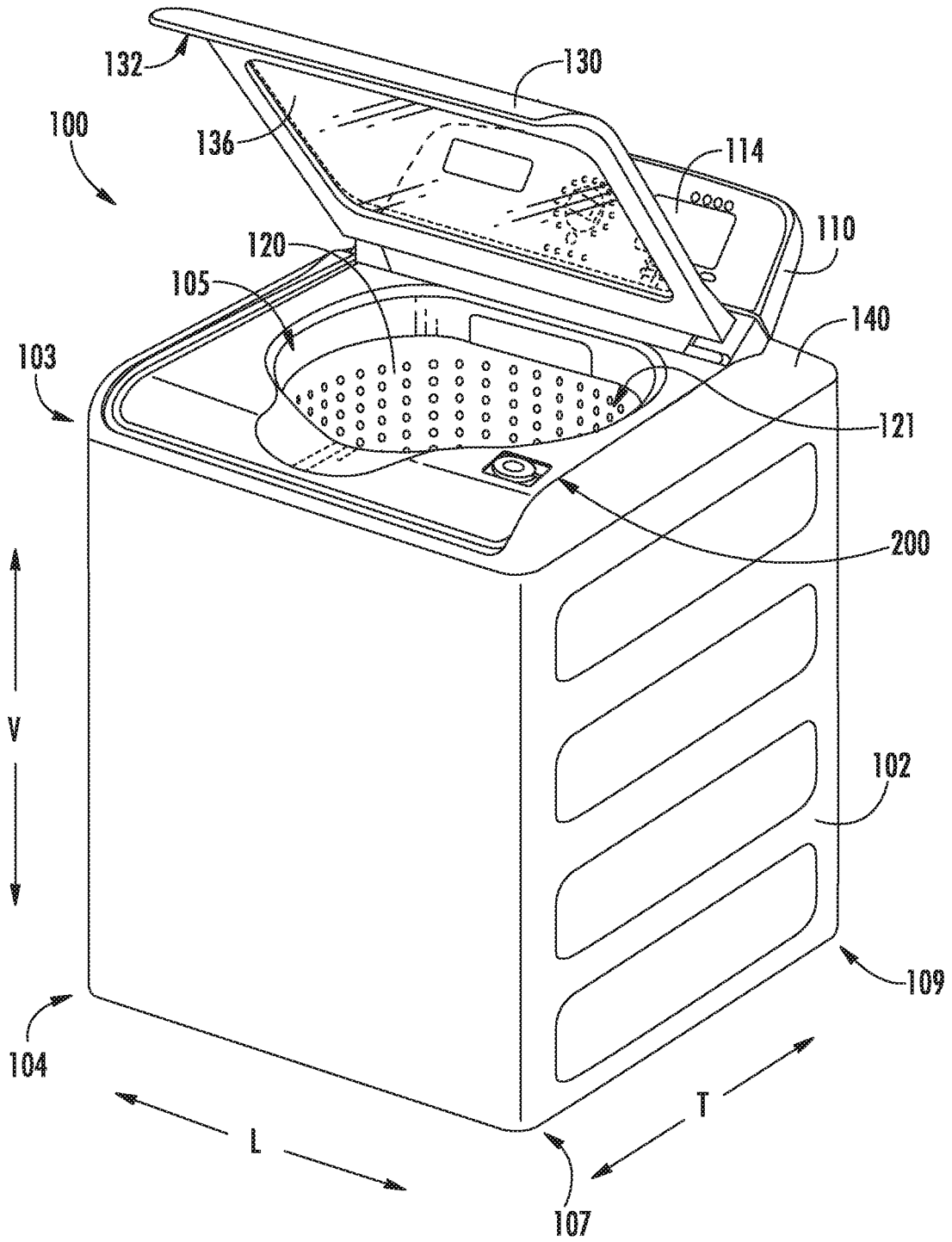
FIG. 2 provides a perspective view of the exemplary washing machine appliance of FIG. 1 with the door of the washing machine appliance shown in an open position.

FIGS. 1 and 2 illustrate an exemplary embodiment of a vertical axis washing machine appliance 100. In FIG. 1, a lid or door 130 of washing machine appliance 100 is shown in a closed position. In FIG. 2, door 130 is shown in an open position. Washing machine appliance 100 generally defines a vertical direction V, a lateral direction L, and a transverse direction T, each of which is mutually perpendicular such that an orthogonal coordinate system is generally defined.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the teachings of the present disclosure as well, e.g., horizontal axis washing machines.

Washing machine appliance 100 has a cabinet 102 that extends between a top portion 103 and a bottom portion 104 along the vertical direction V and between a front 107 and a back 109 along the transverse direction T. A wash basket 120 (FIG. 2) is rotatably mounted within cabinet 102. A motor (not shown) is in mechanical communication with wash basket 120 to selectively rotate wash basket 120 (e.g., during an agitation or a rinse cycle of washing machine appliance 100). Wash basket 120 is received within a wash tub or wash chamber 121 (FIG. 2) and is configured for receipt of articles for washing. Wash tub 121 holds wash and rinse fluids for agitation in wash basket 120 within wash tub 121. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140. Top panel 140 defines an opening 105 (FIG. 2) that permits user access to wash basket 120 of wash tub 121. Door 130, rotatably mounted to top panel 140, permits selective access to opening 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any other suitable support member.

A control panel 110 with at least one input selector 112 (FIG. 1) extends from top panel 140. Control panel 110 and input selector 112 collectively form a user interface for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 (FIG. 1) that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are loaded into wash basket 120 through opening 105, and washing operation is initiated through operator manipulation of input selectors 112. Wash basket 120 is filled with water and detergent and/or other fluid additives via nozzle assembly 200, which will be described in detail below. One or more valves can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through opening 105.

Figure 3:
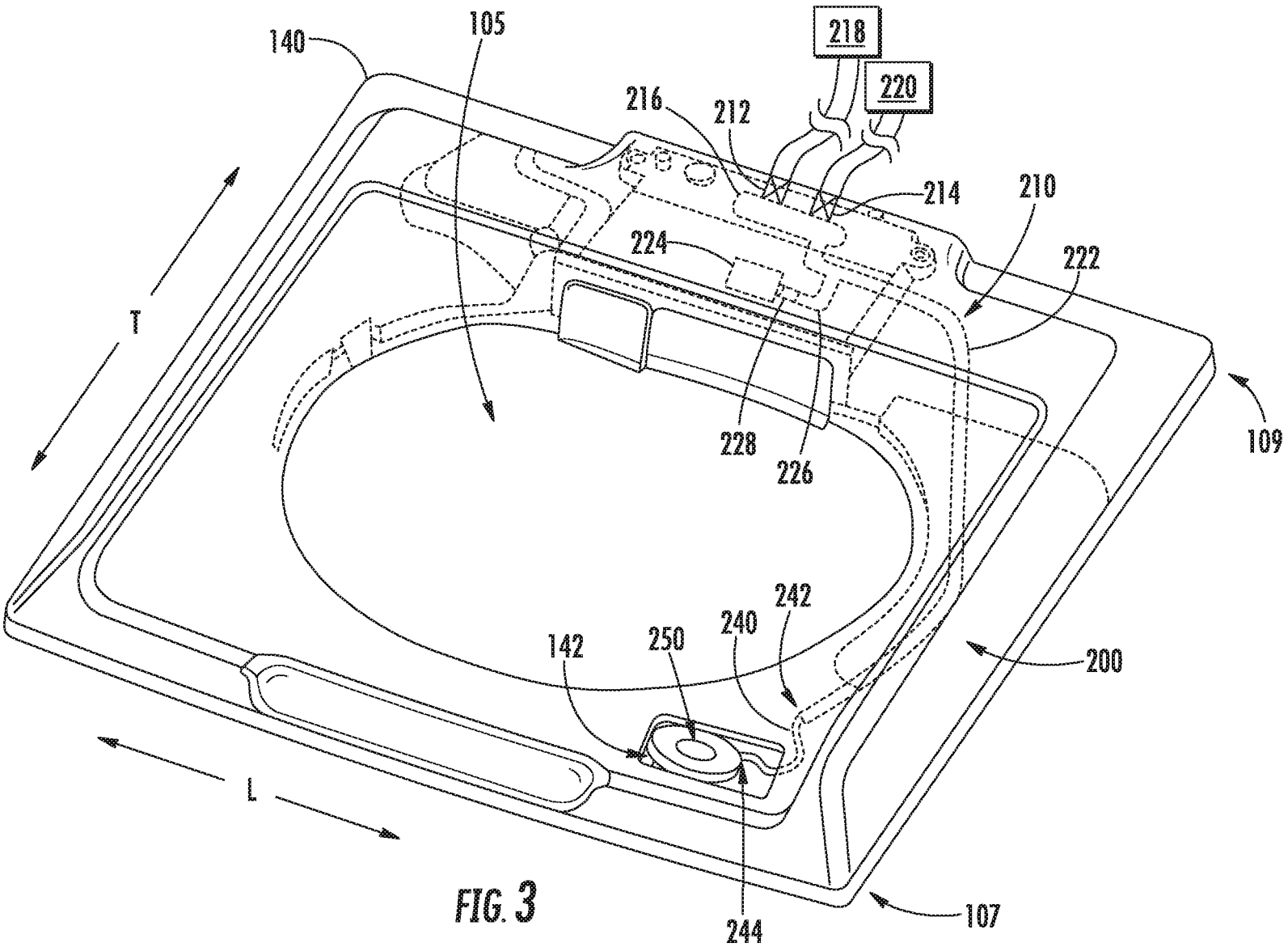
FIG. 3 provides a perspective view of a top panel of the exemplary washing machine appliance of FIG. 1 depicting a spot treating assembly according to an exemplary embodiment of the present disclosure.

As shown in FIGS. 2 and 3, washing machine appliance 100 includes a spot treating assembly 200 for spot treating laundry articles. FIG. 3 provides a perspective view of top panel 140 of the washing machine appliance 100 of FIGS. 1 and 2 and depicts spot treating assembly 200 according to an exemplary embodiment of the present disclosure. In FIG. 3, spot treating assembly 200 is shown partially in phantom lines, and more particularly, components located beneath or within top panel 140 are shown in phantom lines in FIG. 3. Although the discussion below refers spot treating assembly 200 for the washing machine appliance 100 of FIGS. 1 and 2, it will be appreciated that the features and configurations described may be used with or for other washing machine appliances as well.

Generally, spot treating assembly 200 includes a fluid delivery system 210, a hose 240 fluidly connected with fluid delivery system 210, and a spot treating device 250 fluidly connected with hose 240, and thus, spot treating device 250 is fluidly connected with fluid delivery system 210. Spot treating device 250 is operatively configured to spot treat laundry articles, as well as other possible objects or articles.

As depicted in FIG. 3, fluid delivery system 210 of spot treating assembly 200 includes a hot water inlet valve 212 and a cold water inlet valve 214 fluidly connected with a water inlet manifold 216. Hot water inlet valve 212 and cold water inlet valve 214 are each fluidly connected with a fluid supply, which in this embodiment is a hot water supply 218 and a cold water supply 220, respectively, and are each configured to selectively allow a flow of liquid (e.g., water) into water inlet manifold 216. Depending on the desired temperature, the incoming liquid may be mixed in water inlet manifold 216 prior to flowing downstream. A delivery conduit 222 is fluidly connected with water inlet manifold 216 proximate back 109 of top panel 140 and extends toward front 107 of top panel 140. Accordingly, hose 240 is fluidly connected with hot and cold water supplies 218, 220. For this embodiment, delivery conduit 222 is fluidly connected with hose 240 proximate front 107 of top panel 140.

As further provided in FIG. 3, fluid delivery system 210 includes an additive reservoir 224 configured to hold or store one or more wash or treatment additives, such as e.g., detergent, fabric softener, bleach, and/or other suitable wash additives or combinations thereof. An additive conduit 226 fluidly connects additive reservoir 224 with delivery conduit 222. In this way, during a treatment operation, the treating or wash fluid dispensed from spot treating device 250 includes water and one or more treatment additives, which may allow for more efficient removal of stains, for example. For this embodiment, a valve 228 is positioned along additive conduit 226 to selectively allow a predetermined amount of additives into delivery conduit 222. In this manner, the composition of the wash fluid solution flowing downstream to spot treating device 250 is controlled. Generally, the various components of fluid delivery system 210 are positioned underneath top panel 140.

With reference still to FIG. 3, hose 240 extends between an inlet 242 and an outlet 244. Hose 240 is fluidly connected with delivery conduit 222 at inlet 242 and is fluidly connected with spot treating device 250 at outlet 244. Although hose 240 is illustrated as being coupled to delivery conduit 222, it will be appreciated that hose 240 could instead be coupled with an alternative fluid supply source. Furthermore, hose 240 may be any suitable type of semi-rigid or flexible hose. For instance, flexible hose 240 may be constructed from any suitably flexible material, such as vinyl or rubber. Hose 240 is movable between a retracted position (as shown in FIG. 3) and an extended position (e.g., when spot treating device 250 is in use). Moreover, for this embodiment, hose 240 is a spiral hose. In alternative exemplary embodiments, hose 240 may be a retractable hose. In such embodiments, hose 240 may include a retraction mechanism for urging hose 240 in a retracted position. Retraction mechanism may be a torsional spring, for example.

In depicted embodiment of FIG. 3, spot treating device 250 is stowed within a cavity 142 defined by top panel 140 (e.g., when spot treating device 250 is not in use). Cavity 142 is defined proximate front 107 of top panel 140 and is sized to receive spot treating device 250. In this way, spot treating device 250 is readily accessible to a user for use. In alternative exemplary embodiments, spot treating device 250 may be removably positioned on cabinet 102. For instance, spot treating device 250 may be removably mounted on or to an outside wall (e.g., a side wall) of cabinet 102 proximate to top 103 (FIG. 2) of washing machine appliance 100. Accordingly, in such an exemplary embodiment, spot treating device 250 may be conveniently stowed when not in use. Spot treating device 250 may be removably mounted on cabinet 102 of washing machine appliance 100 in any suitable manner. Although not depicted, washing machine appliance 100 may include a holster or hook for mounting of spot treating device 250. Alternatively still, spot treating device 250 may include a magnetic portion such that spot treating device 250 may be removably mounted at any desired location on cabinet 102 of washing machine appliance 100. Accordingly, it should be appreciated that the terms "positioned on" and "mounted on" with reference to spot treating device 250 and cabinet 102 are used generally to mean spot treating device 250 is attached to or positioned adjacent to cabinet 102 and includes embodiments where one or more intermediate components are positioned between spot treating device 250 and cabinet 102 to facilitate the positioning or mounting of spot treating device 250 with cabinet 102.

Figure 4:
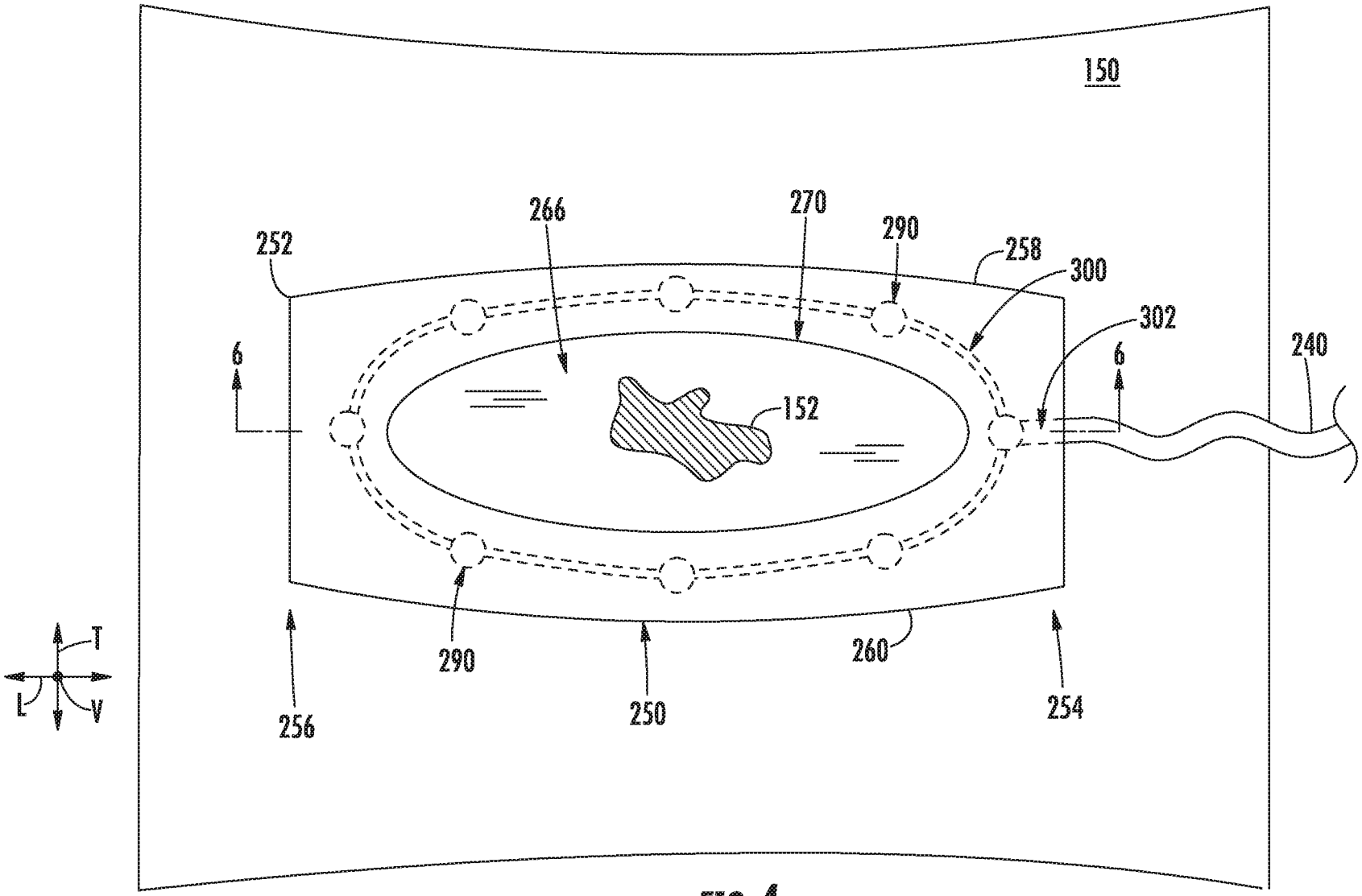
FIG. 4 provides a top view of an exemplary spot treating device of the spot treating assembly of FIG. 3 according to an exemplary embodiment of the present disclosure.
Figure 5:
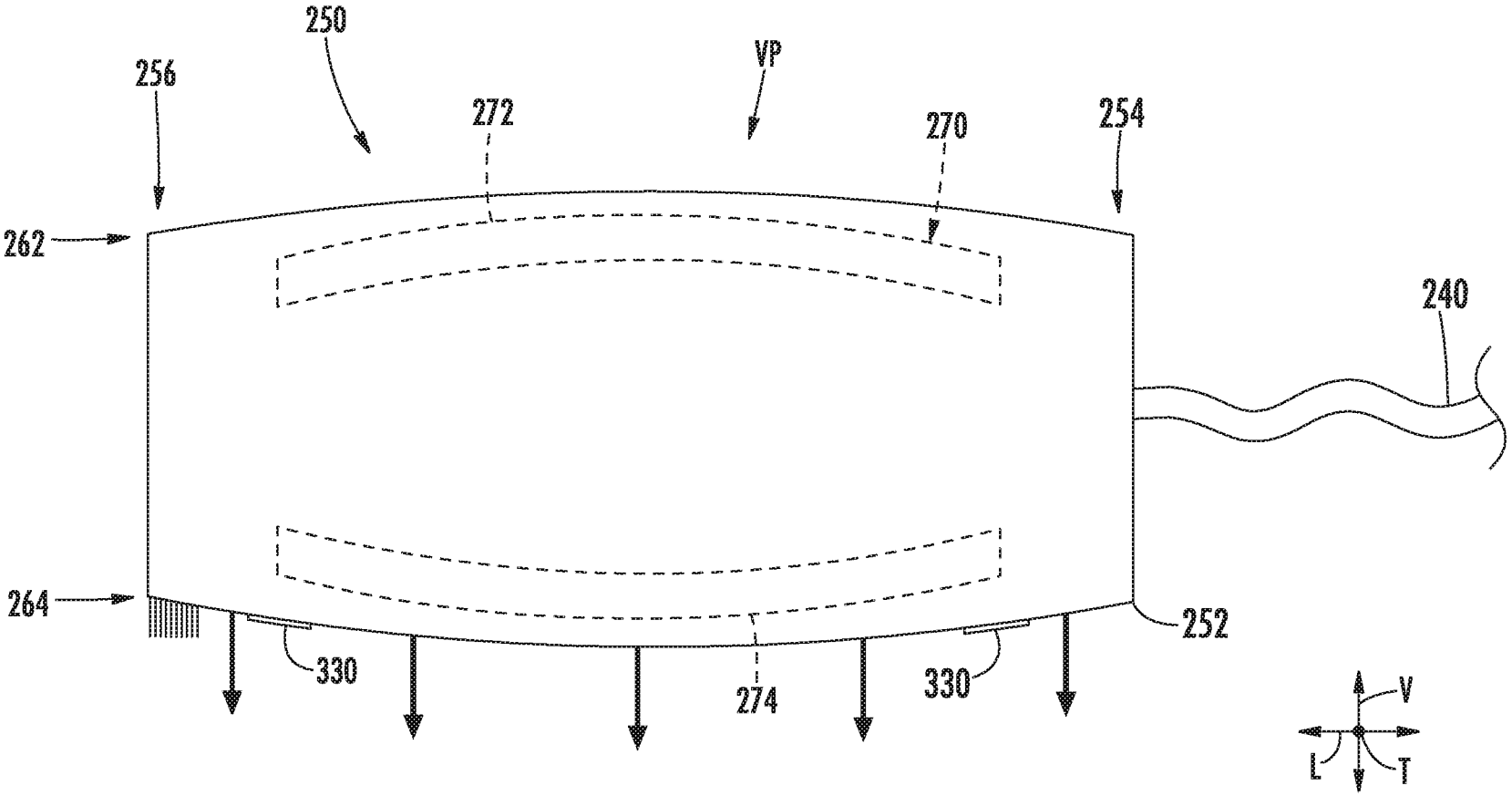
FIG. 5 provides a front elevation view of the spot treating device of FIG. 4.
Figure 6:
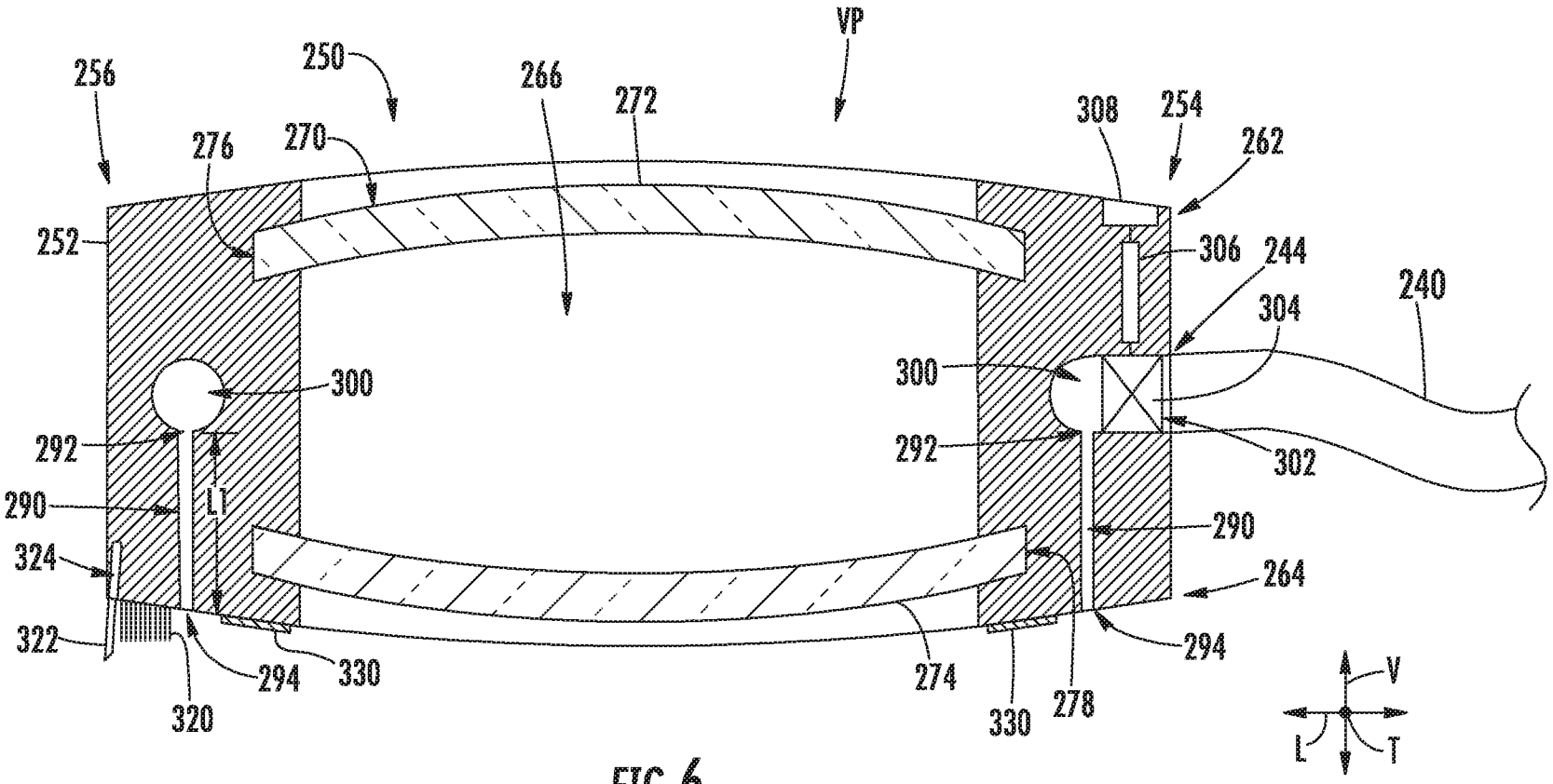
FIG. 6 provides a cross sectional view of the spot treating device of FIG. 4 taken along line 6-6 of FIG. 4.

FIGS. 4 through 6 provide one exemplary embodiment of spot treating device 250. In particular, FIG. 4 provides a top view of the spot treating device 250 of FIGS. 1 through 3, FIG. 5 provides a front elevation view thereof, and FIG. 6 provides a cross sectional view thereof taken along line 6-6 of FIG. 4.

As shown, spot treating device includes a housing 252 that extends between a first end 254 and a second end 256, between a first sidewall 258 and a second sidewall 260 (FIG. 4), and between a top 262 and a bottom 264 (FIG. 5). More particularly, for this embodiment, housing 252 extends between first end 254 and second end 256 along the lateral direction L, between first sidewall 258 and second sidewall 260 along the transverse direction T, and between top 262 and bottom 264 along the vertical direction V. First sidewall 258 and opposing second sidewall 260 are each curved so as to facilitate user handling of spot treating device 250. In particular, first sidewall 258 has concave curvature with respect to second sidewall 260 and second sidewall 260 has concave curvature with respect to first sidewall 258.

As shown in FIG. 6, housing 252 defines a main opening 266 extending therethrough. In particular, for this embodiment, housing 252 defines main opening 266 between top 262 and bottom 264. Main opening 266 is shaped generally as an oval in this exemplary embodiment (FIG. 4), but it will be appreciated that main opening 266 may be other suitable shapes, such as e.g., a rectangle. As main opening 266 extends through housing 252 and is generally centered along the lateral and transverse directions L, T through housing 252, housing 252 forms a ring-like structure. Housing may be formed of any suitable material, such as e.g., plastic.

As further depicted in FIG. 6, spot treating device 250 includes a magnifying device 270 disposed within main opening 266 for magnifying articles, e.g., for magnifying stains on articles. Magnifying device 270 may be any suitable magnifying device capable of magnifying objects. For this embodiment, magnifying device 270 includes a first lens 272 disposed within main opening 266 at or proximate top 262 and a second lens 274 disposed within main opening 266 at or proximate bottom 264 of housing 252. Thus, first lens 272 is spaced apart from second lens 274 along the vertical direction V. First lens 272 is sized to span the entirety of main opening 266 (as shown in FIG. 4) and is mounted to housing 252 by being inserted into an annular top recess 276 defined by housing 252. Likewise, second lens 274 is sized to span the entirety of main opening 266 and is mounted to housing 252 by being inserted into an annular bottom recess 278 defined by housing 252. First lens 272 and second lens 274 may be made of glass, a transparent plastic, acrylic, some combination thereof, or another suitable material.

Moreover, a vantage point VP (FIGS. 5 and 6) is defined above top 262 of housing 252 along the vertical direction V. Vantage point VP may be, for example, the location of the eyes of the user operating spot treating device 250. As shown in FIGS. 5 and 6, for this exemplary embodiment, first lens 272 has a convex shape with respect to the vantage point VP and second lens 274 has a concave shape with respect to the vantage point VP. In this way, the treatment area of laundry articles may be magnified. For instance, as shown in FIG. 4, a stain 152 on article 150 is magnified by magnifying device 270 and more particularly by first lens 272 and second lens 274. In this way, users may more easily visualize the treatment area of article 150.

Housing 252 also defines one or more spray openings 290 (FIG. 6) for dispensing wash or treating fluid, e.g., onto a fabric to spot clean a stain. As shown in FIG. 4, for this exemplary embodiment, housing 252 defines a plurality of spray openings 290 (shown in phantom lines) disposed about main opening 266. In FIG. 5, wash or treating fluid is shown being dispensed from spray openings 290 proximate bottom 264 of housing 252. Spray openings 290 are fluidly connected with hose 240 and with one another via a fluid delivery channel 300 defined by housing 252. As shown in phantom lines in FIG. 4, fluid delivery channel 300 extends annularly about main opening 266 and fluidly connects spray openings 290. Fluid delivery channel 300 may include an attachment mechanism for coupling hose 240 with spot treating device 250. For instance, fluid delivery channel 300 may include a threaded connector that is complementary to a threaded connector of hose 240 such that outlet 244 of hose 240 is fluidly connected with an inlet 302 of fluid delivery channel 300.

As shown in FIG. 6, at least one spray opening 290 may be tapered along the length of the opening. For instance, in the depicted embodiment of FIG. 6, the spray opening 290 positioned proximate second end 256 tapers along the length L1 of the spray opening along the vertical direction V. More particularly, for this embodiment, the tapering spray opening 290 extends between an inlet 292 and an outlet 294. Inlet 292 is contiguous with fluid delivery channel 300 and outlet 294 is positioned proximate bottom 264. As shown, spray opening 290 tapers between inlet 292 and outlet 294. More specifically, for this embodiment, spray opening 290 tapers from inlet 292 to outlet 294 along the vertical direction V. In this manner, the tapered spray opening 290 may dispense a jet-like flow from outlet 294 of tapered spray opening 290. In some embodiments, a plurality of spray openings 290 taper between their respective inlets 292 and outlets 294.

As further provided in FIG. 6, one or more spray openings 290 may extend along the vertical direction V without tapering. Stated alternatively, one or more spray openings 290 may have substantially the same diameter or cross sectional area and shape as they extend along the vertical direction V. In this way, the non-tapered spray opening 290 may dispense wash fluid as a thicker, soaker-like stream. For instance, in the depicted embodiment of FIG. 6, the spray opening 290 positioned proximate first end 254 does not taper along the length of the spray opening along the vertical direction V; rather, spray opening 290 has substantially the same cross sectional area and shape as it extends between inlet 292 and outlet 294. For this embodiment, as spot treating device 250 includes one or more tapered spray openings and one or more non-tapered spray openings, spot treating device 250 provides flexibility as to the type of wash fluid stream dispensed from spot treating device 250.

Further, as depicted in FIG. 6, spot treating device 250 includes an inlet valve 304 positioned at inlet 302 of fluid delivery channel 300 for selectively allowing a flow of wash fluid into spot treating device 250. Spot treating device 250 includes an actuation mechanism 306 for actuating inlet valve 304 between an open position to allow a flow of wash fluid into spot treating device 250 and a closed position to prevent a flow of wash fluid into spot treating device 250. As one example, actuation mechanism 306 may be a motor mechanically coupled with inlet valve 304. Moreover, spot treating device 250 includes an activation mechanism 308 for triggering the actuation mechanism 306. For instance, continuing with the example above, activation mechanism 308 may be a button electrically connected with the motor actuation mechanism 306. That is, upon user manipulation of the button activation mechanism, an electrical signal is sent to motor actuation mechanism 306 that in turn causes inlet valve 304 to actuate, e.g., to an open or a closed position.

As further depicted in FIGS. 5 and 6, spot treating device 250 includes a brush 320 attached to housing 252. In particular, for this embodiment, bristles of brush 320 extend from bottom 264 proximate second end 256 of housing 252. Brush 320 provides a user with means to rub or scrub a stain or treatment area of an article. As further depicted, spot treating device 250 includes a scraper 322 extending from bottom 264 proximate second end 256 of housing 252. Scraper 322 provides a user with means to scrape a stain or treatment area of an article. For this embodiment, scraper 322 is retractable. That is, scraper 322 is movable between a retracted position (FIG. 5) and an extended position (FIG. 6). As shown in FIG. 6, scraper 322 may retract into a recess 324 defined by housing 252. A retraction mechanism may urge scraper 322 within recess 324. For instance, retraction mechanism may be a torsional spring. Further, spot treating device 250 may include activation mechanism that allows a user to selectively extend or retract scraper 322. For instance, activation mechanism may be a button or a trigger handle, for example.

As depicted particularly in FIG. 6, for this exemplary embodiment, spot treating device 250 includes illumination devices 330. In particular, spot treating device 250 includes one illumination device 330 positioned proximate first end 254 and one illumination device 330 positioned proximate second end 256 along bottom 264 of housing 252. Illumination devices 330 may be attached to bottom 264 of housing 252 in any suitable manner, such as e.g., by an adhesive. Illumination devices 330 may be any suitable type of illumination device. As one example, illumination devices 330 may be LED strips. Illumination devices 330 of spot treating device 250 may provide an illuminated visual rendering of a treatment area of an article during a treatment operation. In some embodiments, spot treating device 250 may include more than two illumination devices or less than two illumination devices. Illumination devices 330 may be activated by motion, by actuation of an activation mechanism, such as e.g., a button or trigger, or by other suitable methods.

Figure 7:
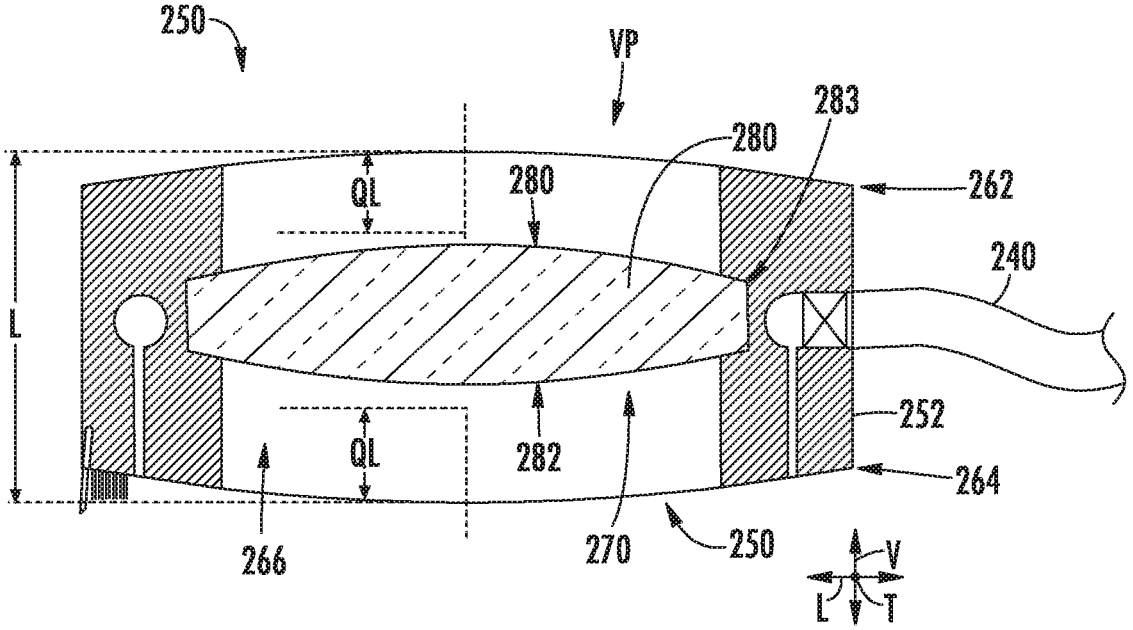
FIG. 7 provides a cross sectional view of another exemplary spot treating device according to an exemplary embodiment of the present disclosure.

FIG. 7 provides a cross sectional view of another exemplary spot treating device 250 according to an exemplary embodiment of the present disclosure. The exemplary spot treating device 250 of FIG. 7 is configured in a similar manner as the spot treating device of FIGS. 4 through 6, and accordingly, the same or similar reference numerals refer to the same or similar parts, except as noted below.

For this exemplary embodiment, magnifying device 270 includes a single lens 280 having a top surface 281 and an opposing bottom surface 282. Lens 280 is disposed within main opening 266 and is sized to span the entirety of main opening 266. Further, lens 280 is mounted to housing 252 by being inserted into an annular recess 283 defined by housing 252. For this embodiment, lens 280 is centered between top 262 and bottom 264 along the vertical direction V. Further, top surface 281 is spaced from top 262 along the vertical direction V and bottom surface 282 of lens 280 is spaced from bottom 264 of housing 252 along the vertical direction V. More particularly, top surface 281 is spaced from top 262 by at least a quarter length QL of the vertical length L of housing 252 and bottom surface 282 of lens 280 is spaced from bottom 264 by at least a quarter length QL of the vertical length L of housing 252. In this way, lens 280 is recessed within main opening 266 and is protected from splashing from dispensed wash fluid. Further, in such embodiments, top surface 281 has a convex shape with respect to the vantage point VP and bottom surface 282 has a concave shape with respect to the vantage point VP.

Figure 8:
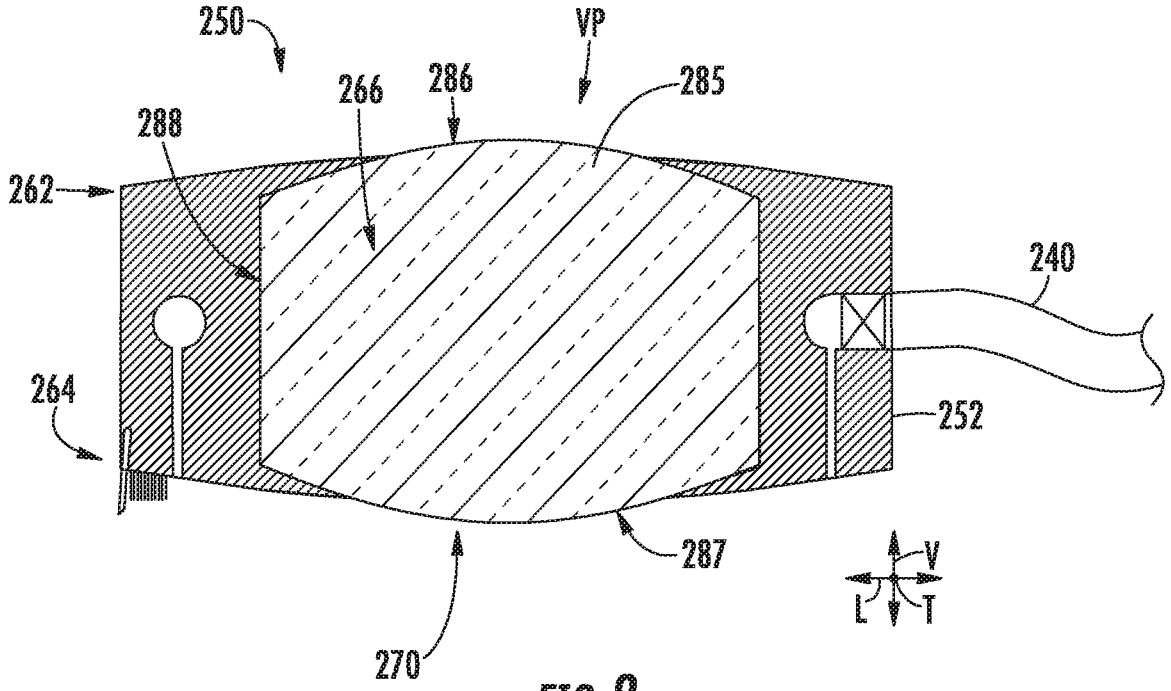
FIG. 8 provides a cross sectional view of yet another exemplary spot treating device according to an exemplary embodiment of the present disclosure.

FIG. 8 provides a cross sectional view of yet another exemplary spot treating device 250 according to an exemplary embodiment of the present disclosure. The exemplary spot treating device 250 of FIG. 8 is configured in a similar manner as the spot treating device of FIGS. 4 through 6 and 7, and accordingly, the same or similar reference numerals refer to the same or similar parts, except as noted below.

For this exemplary embodiment, magnifying device 270 includes a single lens 285 having a top surface 286 and an opposing bottom surface 287. Lens 285 is disposed within main opening 266 and is sized to span extend over the entirety of main opening 266. Further, lens 285 is mounted to housing 252 by being inserted into an annular recess 288 defined by housing 252 and is positioned or disposed within main opening 266 such that top surface 286 of lens 285 is positioned at or proximate top 262 of housing 252 and bottom surface 287 is positioned at or proximate bottom 264 of housing 252. More particularly, for this embodiment, top surface 286 extends above or beyond top 262 of housing 252 along the vertical direction V and bottom surface 287 extends below bottom 264 along the vertical direction V. In such embodiments, as lens 285 extends further than the total length L of housing 252, the magnification of the treatment area of an article undergoing a spot treatment operation may be amplified or increased. Further, in such embodiments, top surface 286 has a convex shape with respect to the vantage point VP and bottom surface 287 has a concave shape with respect to the vantage point VP.

Figure 9:
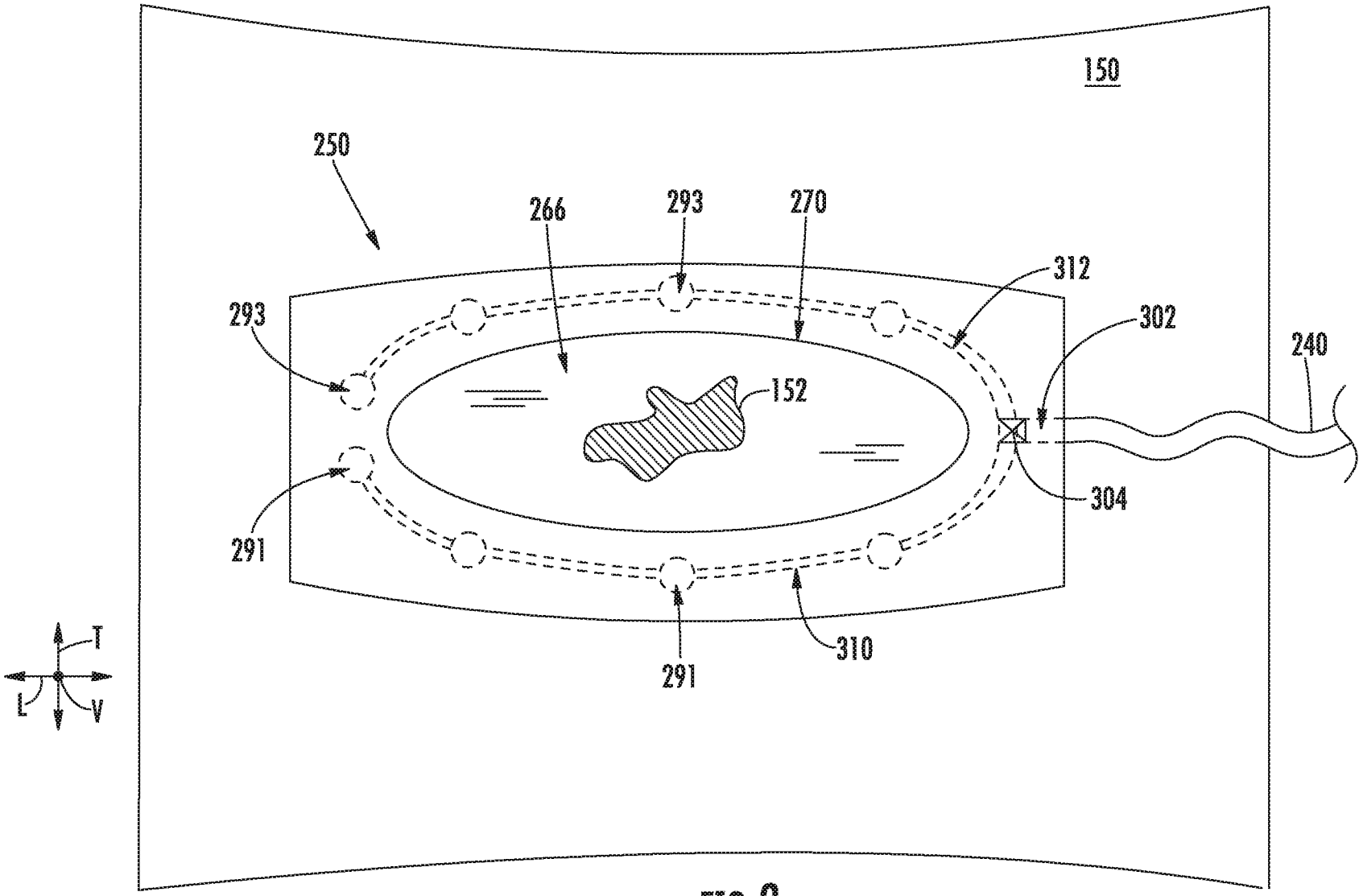
FIG. 9 provides a top view of another exemplary spot treating device according to an exemplary embodiment of the present disclosure.

FIG. 9 provides a top plan view of yet another exemplary spot treating device 250 according to an exemplary embodiment of the present disclosure. The exemplary spot treating device 250 of FIG. 9 is configured in a similar manner as the spot treating device of FIGS. 4 through 6, 7, and 8, and accordingly, the same or similar reference numerals refer to the same or similar parts, except as noted below.

For this exemplary embodiment, fluid delivery channel includes inlet 302 and a first channel 310 extending from inlet 302 and an opposing second channel 312 extending from inlet 302 in a direction opposite first channel 310. As depicted, in this embodiment, fluid delivery channel does not extend about main opening 266. A plurality of spray openings are positioned along first channel 310 and a plurality of spray openings are positioned along second channel 312. More particularly, tapered spray openings 291 are positioned along first channel 310 and non-tapered spray openings 293 are positioned along second channel 312. In addition, for this exemplary embodiment, inlet valve 304 is a three-way valve that is positioned and configured to selectively allow wash fluid into spot treating device 250 and is also configured to selectively allow wash fluid into first channel 310, second channel 312, or both. A user may adjust the setting of spot treating device 250 such that inlet valve 304 allows wash fluid into the desired channel. For instance, if a pressurized stream of wash fluid is desired, a user may adjust spot treating device 250 such that inlet valve 304 allows wash fluid into first channel 310, which in turn allows the wash fluid to flow through the tapered spray openings 291 that dispense a jet-like stream of wash fluid. Alternatively, if a lower pressure, thick soaker-like stream is desired, a user may adjust spot treating device 250 such that inlet valve 304 allows wash fluid into second channel 312, which in turn allows wash fluid to flow through non-tapered spray openings 293 that dispense a thicker, soaker-like stream of wash fluid.

Figure 10:
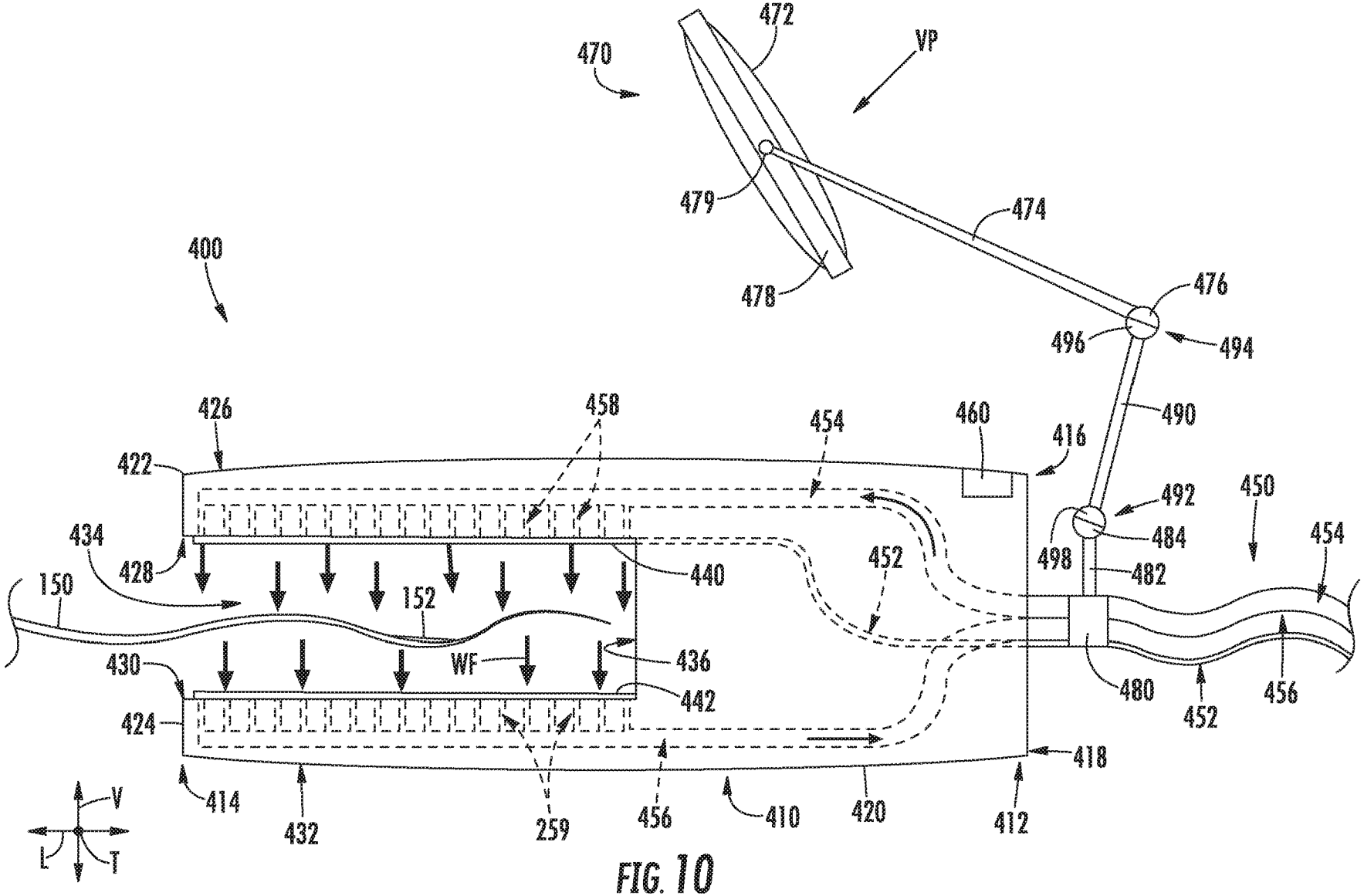
FIG. 10 provides a front elevation view of another exemplary spot treating device according to an exemplary embodiment of the present disclosure.

FIG. 10 provides a front elevation view of another exemplary spot treating device according to an exemplary embodiment of the present disclosure. For this exemplary embodiment, spot treating device is an ultrasonic spot treating device 400. Ultrasonic device 400 may be configured for use with the washing machine appliance 100 of FIGS. 1 through 3 or any other suitable washing machine appliance.

As depicted in FIG. 10, ultrasonic device 400 includes a housing 410 that extends between a first end 412 and a second end 414 and between a top 416 and a bottom 418. More particularly, for this embodiment, housing 410 extends between first end 412 and second end 414 along the lateral direction L and extends between top 416 and bottom 418 along the vertical direction V. Housing 410 includes a main body 420 and a top member 422 extending outward from main body 420 along the lateral direction L. Further, a bottom member 424 likewise extends outward from main body 420 along the lateral direction L. Top member 422 is spaced from bottom member 424 along the vertical direction V. In some embodiments, top member 422 is adjustable relative to bottom member 424 along the vertical direction V. For instance, top member 422 may be adjustable along a vertical track. This may, for example, provide for improved spot cleaning of the treatment area of an article. Top member 422 extends between a top wall 426 and a bottom wall 428 along the vertical direction V. Likewise, bottom member 424 extends between a top wall 430 and a bottom wall 432 along the vertical direction V. As depicted in FIG. 10, housing 410 defines a cavity 434. More specifically, cavity 434 is defined by bottom wall 428 of the top member 422, top wall 430 of bottom member 424, and a wall 436 of main body 420 of housing 410.

Referring still to FIG. 10, an ultrasonic plate 440 is shown positioned or mounted on bottom wall 428 of top member 422 and disposed within cavity 434. Ultrasonic plate 440 may contact a treatment area of article 150 to convey ultrasonic vibrations thereto, e.g., convey ultrasonic vibrations to stain 152. For this embodiment, a fluid delivery conduit 450 includes an air conduit 452 that provides a flow of pressurized air to shake or vibrate ultrasonic plate 440 to a predetermined frequency. For instance, the predetermined frequency may be a frequency above twenty (20) kHz. Additionally or alternatively, in some embodiments, ultrasonic device 400 may include a power supply (e.g., a battery or a remotely-accessed outlet supply) that powers a frequency generator that drives ultrasonic plate 440 to the predetermined frequency. Such frequency generators may include, for example, a solid-state (e.g., MOSFET circuit) operated system or other feedback or feedforward control systems. The frequency generator may drive a transducer that, in turn, drives ultrasonic plate 440 to convey ultrasonic vibrations to the treatment area of article 150. A user may trigger a flow of pressurized air through air conduit 452 by manipulating activation member 460, for example. Activation member 460 may be, for example, a button electrically connected with an actuation mechanism (not shown) configured to open or close a valve (not shown) positioned within air conduit 452.

Fluid delivery conduit 450 includes a dispensing conduit 454 that provides wash fluid to a plurality of spray openings 458 (shown in phantom in FIG. 10) defined by top member 422 and ultrasonic plate 440. Thus, dispensing conduit 454 is fluidly connected with spray openings 458. A user may trigger a flow of wash fluid dispensing conduit 454 by manipulating activation member 460. Continuing with the example above, activation member 460 may include a separate button electrically connected with an actuation mechanism configured to open or close a valve positioned within dispensing conduit 454. Wash fluid may be dispensed through spray openings 458 such that a user may further treat an article with wash fluid. For example, prior to utilizing the ultrasonic functionality of ultrasonic device 400, a user may treat the treatment area with wash fluid. This may, for example, provide improved or more efficient spot cleaning of articles.

Further, ultrasonic device 400 includes a suction plate 442 positioned or mounted on top wall 430 of bottom member 424 and disposed within cavity 434. Suction plate 442 and bottom member 424 define a plurality of suction openings 259 (shown in phantom in FIG. 10) that collect wash fluid WF dispensed from spray openings 458. Fluid delivery conduit 450 includes a suction conduit 456 that is fluidly connected with suction openings 259. During treatment operation, once wash fluid is collected by suction openings 259, the soiled wash fluid is removed from ultrasonic device 400 by suction conduit 456. Suction conduit 456 may be fluidly connected with a gray line (e.g., for removing gray water from washing machine appliance 100) or may be fluidly connected with wash chamber 121. Fluid delivery conduit 450 may include a flexible, hard outer shell and may encase air conduit 452, dispensing conduit 454, and suction conduit 456 into a single conduit.

As further illustrated in FIG. 10, ultrasonic device 400 includes a magnifying device 470 having a magnifying lens 472. Magnifying device 470 includes a shaft 474 extending from a frame 478 that houses magnifying lens 472. Shaft 474 includes a ball 476 at its end opposite where shaft 474 is connected with frame 478. A pivot device 479 couples shaft 474 with frame 478 and is operatively configured to provide for rotation of magnifying device 470. For instance, in this exemplary embodiment, pivot device 479 allows for magnifying device 470 to pivot or rotate about the transverse direction T.

As depicted, a clamp 480 is secured to fluid delivery conduit 450. Clamp 480 may be a frictional handle clamp, for example. Clamp 480 may define an aperture sized to receive fluid delivery conduit 450. To install clamp 480 on fluid delivery conduit 450, clamp 480 may be snap fit over fluid delivery conduit 450 and then may be slid into a desired position. The friction between clamp 480 and fluid delivery conduit 450 maintains secure mounting of clamp 480 to fluid delivery conduit 450. Additionally or alternatively, mechanical fasteners may further secure clamp 480 with fluid delivery conduit 450.

Magnifying device 470 is adjustably attached to fluid delivery conduit 450. Clamp 480 includes a clamp shaft 482 extending therefrom. Clamp shaft 482 includes a clamp ball 484 at its distal end as shown in FIG. 10. An extension shaft 490 extends between a proximal end 492 and a distal end 494 and couples clamp 480 with magnifying device 470. Extension shaft 490 includes an upper socket 496 at its distal end 494 and a lower socket 498 at its proximal end 492. Extension shaft 490 is adjustably attached to clamp 480. In particular, proximal end 492 of extension shaft 490 is adjustably attached to clamp 480 as clamp ball 484 is received within and frictionally mates with lower socket 498 of extension shaft 490. In this way, extension shaft 490 is coupled with clamp 480 via a ball socket joint. Likewise, extension shaft 490 is adjustably attached to magnifying device 470. In particular, distal end 494 of extension shaft 490 is adjustably attached to magnifying device 470 as ball 476 is received within and frictionally mates with upper socket 496 of extension shaft 490. In this way, extension shaft 490 is coupled with magnifying device 470 via a ball socket joint. Accordingly, magnifying device 470 is adjustable relative to ultrasonic device 400, which may allow for a user to adjust magnifying lens 472 for an improved visual rendering of the treatment area of an article.

Although the ball socket joints depicted in FIG. 10 shows sockets 496, 498 installed on extension shaft 490, and balls 484, 476 installed on clamp shaft 482 of clamp 480 and shaft 474 of magnifying device 470, respectively, it is envisioned to be within the scope of the present disclosure that one or more of the balls be installed on extension shaft 490, and the corresponding socket(s) be installed on magnifying device 470 and/or clamp 480.

Figure 11:
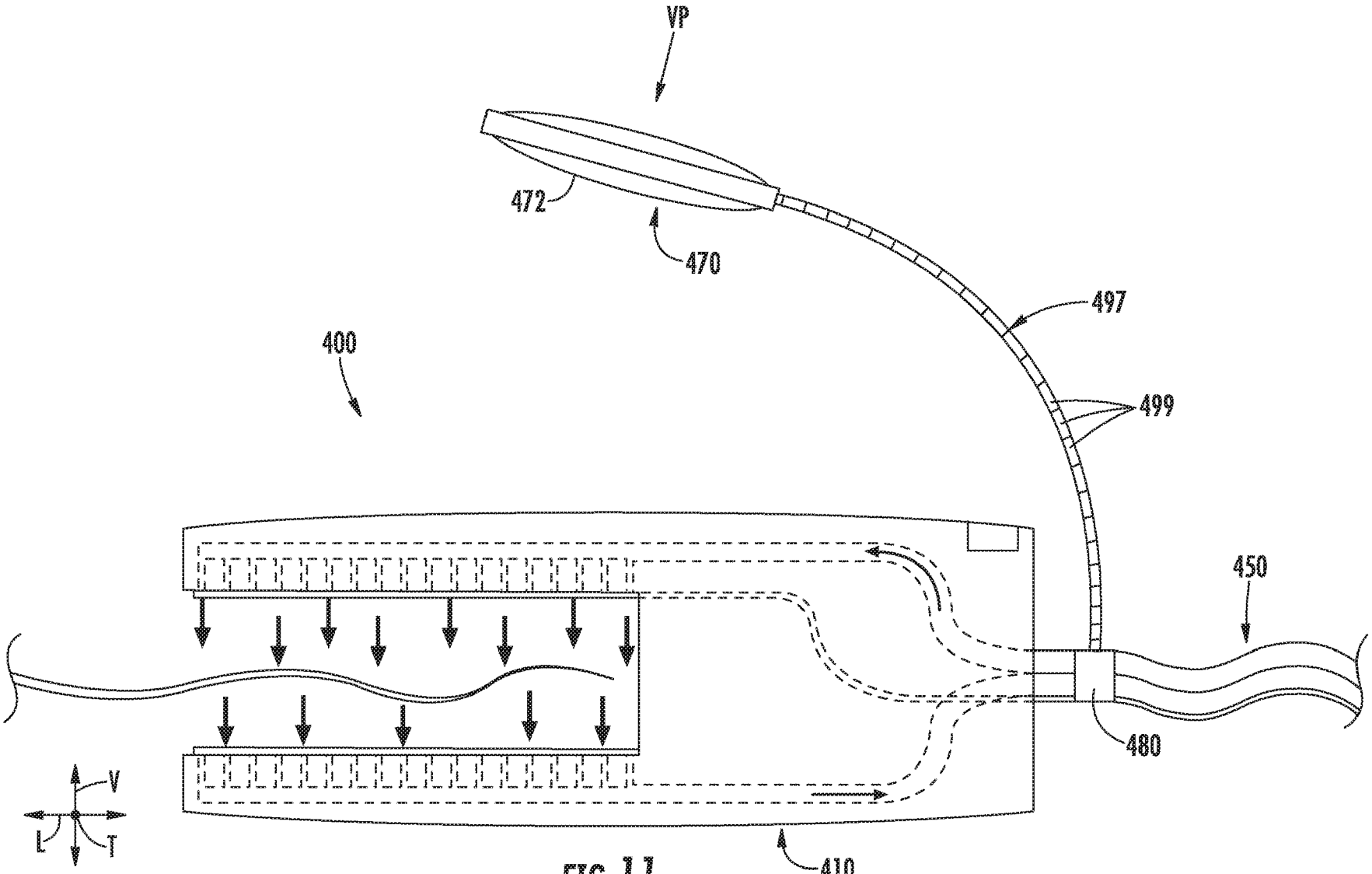
FIG. 11 provides a front elevation view of yet another exemplary spot treating device according to an exemplary embodiment of the present disclosure.

FIG. 11 provides a front elevation view of yet another exemplary spot treating device according to an exemplary embodiment of the present disclosure. For this exemplary embodiment, spot treating device is an ultrasonic spot treating device 400. The exemplary ultrasonic device 400 of FIG. 11 is configured in a similar manner as the ultrasonic device of FIG. 10, and accordingly, the same or similar reference numerals refer to the same or similar parts.

In contrast with the ultrasonic device of FIG. 10, ultrasonic device 400 of FIG. 11 includes a gooseneck or linked shaft 497 coupling clamp 480 with magnifying device 470. As shown, linked shaft 497 includes a series of frictionally attached links 499, which allow linked shaft 497 to articulate and assume complex shapes. To position magnifying device 470, a user may bend linked shaft 497 into the desired shape so as to locate magnifying lens 472 such that the treatment area of an article is magnified. When linked shaft 497 is bent or articulated to the desired position, the frictional fit between the links 499 causes linked shaft 497 to retain its shape.

In alternative exemplary embodiments, the magnifying device 470 may be coupled with or attached to housing 410 of the ultrasonic spot treating device 400 of FIG. 10 or FIG. 11. As one example, in such embodiments, a shaft may extend from top 416 of housing 410 and have a ball at its distal end. Lower socket 498 of extension shaft 490 may receive and frictionally mate with the ball of the shaft extending from housing 410. In this way, magnifying device 470 is coupled with housing 410. As another example, a base link integral with or attached to housing 410 may extend therefrom (e.g., from top 416). In such embodiments, one or more links 499 of linked shaft 497 may be frictionally attached to the base link. In this manner, linked shaft 497 may be attached to or coupled with housing 410.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical, a lateral, and a transverse direction, the washing machine appliance comprising:

a cabinet including a top panel, the top panel defining an opening;

a tub positioned within the cabinet;

a wash basket rotatably mounted within the tub, the wash basket defining a wash chamber for receiving articles for washing; and a spot treating assembly for treating articles, the spot treating assembly comprising:

a hose fluidly connected with a water supply; and a spot treating device, comprising:

a housing defining a main opening extending therethrough and one or more spray openings fluidly connected with the hose for dispensing a wash fluid; and a magnifying device disposed within the main opening of the housing for magnifying articles.

2. The washing machine appliance of claim 1, wherein the housing extends between a top and a bottom along the vertical direction, and wherein the magnifying device comprises a first lens disposed within the main opening at or proximate the top and a second lens disposed within the main opening at or proximate the bottom of the housing.

3. The washing machine appliance of claim 2, wherein a vantage point is defined above the top of the housing along the vertical direction, and wherein the first lens has a convex shape with respect to the vantage point and the second lens has a concave shape with respect to the vantage point.

4. The washing machine appliance of claim 1, wherein the one or more spray openings comprise at least one spray opening extending between an inlet and an outlet, and wherein the at least one spray opening tapers between the inlet and the outlet.

5. The washing machine appliance of claim 1, wherein the housing extends between a top and a bottom along the vertical direction, and wherein a vantage point is defined above the top of the housing along the vertical direction, and wherein the magnifying device comprises a lens having a top surface and an opposing bottom surface, the lens disposed within the main opening such that the top surface of the lens is positioned at or proximate the top of the housing and the bottom surface is positioned at or proximate the bottom of the housing, and wherein the top surface has a convex shape with respect to the vantage point and the bottom surface has a concave shape with respect to the vantage point.

6. The washing machine appliance of claim 1, wherein the spot treating device further comprises a brush attached to the housing.

7. The washing machine appliance of claim 1, wherein the spot treating device further comprises an illumination device attached to the housing.

8. The washing machine appliance of claim 1, wherein the spot treating device further comprises a scraper, wherein the scraper is retractable within a recess defined by the housing of the spot treating device.

9. The washing machine appliance of claim 1, wherein the housing defines a fluid delivery channel fluidly connecting the one or more spray openings with the hose and with one another, and wherein the fluid delivery channel extends annularly about the main opening.

10. The washing machine appliance of claim 9, wherein the fluid delivery channel comprises an inlet, and wherein the spot treating device further comprises an inlet valve positioned at the inlet for selectively allowing a flow of wash fluid into the spot treating device.

11. The washing machine appliance of claim 10, wherein the spot treating device further comprises:

an actuation mechanism for actuating the inlet valve between an open position and a closed position; and an activation mechanism for triggering the actuation mechanism.

12. The washing machine appliance of claim 1, wherein the housing defines a fluid delivery channel fluidly connecting the one or more spray openings with the hose, the fluid delivery channel comprising a first channel and a second channel, and wherein the one or more spray openings comprise at least one tapered spray opening along the first channel and the one or more spray openings comprise at least one non-tapered opening along the second channel, the fluid delivery channel having an inlet, the spot treating device further comprising:

an inlet valve positioned at the inlet of the fluid delivery channel for selectively allowing a flow of wash fluid into the first channel and selectively allowing a flow of wash fluid into the second channel.

13. The washing machine appliance of claim 1, wherein the hose is a spiral hose moveable between an extended positon and a retracted position.

14. A washing machine appliance defining a vertical, a lateral, and a transverse direction, the washing machine appliance comprising:

a cabinet including a top panel, the top panel defining an opening;

a tub positioned within the cabinet;

a wash basket rotatably mounted within the tub, the wash basket defining a wash chamber for receiving articles for washing; and a spot treating device for treating articles, comprising:

a housing comprising a main body, a top member extending outward from the main body, and a bottom member extending outward from the main body and spaced from the top member, the main body, the top member, and the bottom member defining a cavity;

a fluid delivery conduit fluidly connecting the spot treatment device with a fluid supply; and a magnifying device attached to at least one of the fluid delivery conduit and the housing for magnifying articles;

an ultrasonic plate for conveying ultrasonic vibrations to articles, the ultrasonic plate attached to the top member and disposed within the cavity, the ultrasonic plate and top member defining a plurality of spray openings for dispensing a wash fluid onto articles; and a suction plate for collecting wash fluid dispensed from spray openings, the suction plate attached to the bottom member and disposed within the cavity.

15. The washing machine appliance of claim 14, further comprising:

a top panel, the top panel defining a cavity sized to receive the spot treating device.

16. The washing machine appliance of claim 14, wherein the magnifying device is attached to the fluid delivery conduit by a linked shaft comprised of a series of frictionally attached links.

17. The washing machine appliance of claim 14, wherein the magnifying device comprises a frame and a shaft extending from the frame, wherein the washing machine appliance further comprises:

a clamp sized to receive the fluid delivery conduit and comprising a clamp shaft extending therefrom; and an extension shaft extending between a proximal end and a distal end, the proximal end coupled with the clamp shaft via a ball socket joint, and wherein the distal end of the extension shaft is coupled with the shaft of the magnifying device via a ball socket joint.

* * * * *